US006567055B1

(12) United States Patent
Oglesby

(10) Patent No.: US 6,567,055 B1
(45) Date of Patent: May 20, 2003

(54) METHOD AND SYSTEM FOR GENERATING A BALANCED FEED FOR RF CIRCUIT

(75) Inventor: Stephen M. Oglesby, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 09/846,828

(22) Filed: May 1, 2001

(51) Int. Cl.[7] ..... H01Q 9/28
(52) U.S. Cl. ..... 343/795; 343/700 MS
(58) Field of Search ..... 343/795, 700 MS, 343/793, 906, 818, 821

(56) References Cited

U.S. PATENT DOCUMENTS 5,021,799 A * 6/1991 Kobus et al. ..... 343/795
6,337,666 B1 * 1/2002 Bishop ..... 343/795

* cited by examiner

*Primary Examiner*—James Clinger
(74) *Attorney, Agent, or Firm*—Nathan O. Jensen; Kyle Eppele

(57) ABSTRACT

A system and method for generating a balanced feed from an unbalanced feed, which uses a pair of vertically aligned microstrip traces on opposing sides of a printed circuit board to act as a balun and an antenna array using a collinear dipole array.

18 Claims, 2 Drawing Sheets

METHOD AND SYSTEM FOR GENERATING A BALANCED FEED FOR RF CIRCUIT

FIELD OF THE INVENTION

The present invention generally relates to RF baluns, and more particularly relates to transforming an unbalanced microstrip transmission line into a balanced printed parallel transmission line, and even more particularly relates to printed circuit methods and systems for providing a balanced feed for an RF circuit without the need for external components.

BACKGROUND OF THE INVENTION

In recent years, the popularity of radio communications has continued to increase. With more demand for radio equipment, the competition between manufacturers and suppliers of radio communication equipment can likewise be expected to increase. Areas in which these suppliers may be expected to compete would be on the size, price and durability of such equipment.

Numerous electronic devices use baluns to generate a balanced feed from an unbalanced source. One example is a typical global positioning system receiver. In such receivers, it is common to see a packaged discrete balun disposed between a GPS antenna and a receiver.

While these discrete baluns have been used extensively in the past, they do have some drawbacks. First of all, these discrete baluns add expense to the radio. Secondly, these baluns, and often their associated structures, increase the bulk of the radio. Lastly, these discrete baluns may have some electrical performance problems owing to packaging and interconnect parasitics.

Consequently, there exists a need for improved methods and systems for generating a balanced feed for RF circuits in an efficient manner.

SUMMARY OF THE INVENTION

It is an object of the present invention to provide a system and method for generating a balanced feed for an RF circuit in an efficient manner.

It is a feature of the present invention to utilize a balun integrated with a printed circuit board.

It is another feature of the present invention to include a pair of vertically aligned microstrip traces disposed on opposing sides of a printed circuit board.

It is another feature of the present invention to have a printed dipole antenna coupled to the balun of the present invention.

It is an advantage of the present invention to achieve improved efficiency in generating a balanced feed for RF circuits.

The present invention is an apparatus and method for balancing an RF feed, which is designed to satisfy the aforementioned needs, provide the previously stated objects, include the above-listed features, and achieve the already articulated advantages. The present invention is carried out in a "discrete balun-less" manner in a sense that the requirement for a discrete balun circuit between an antenna and a radio has been eliminated or greatly reduced.

Accordingly, the present invention is a system and method including a printed circuit card having a balun printed thereon, which includes two microstrip traces on opposing sides of the printed circuit boards.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
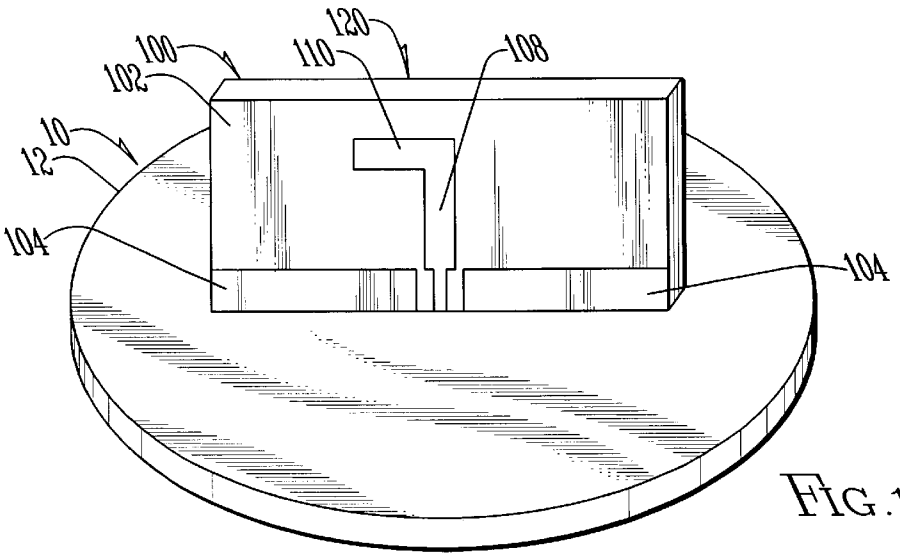
FIG. 1 is a perspective view of a ground plane disk and circuit board combination of the present invention.

Now referring to the drawings wherein like numerals refer to like matter throughout, and more specifically referring to FIG. 1, there is shown a system of the present invention generally designated 10, including a ground plane 12, which can be any type of conductive grounding surface; a disk is shown, but other shapes could be used as well. Where a single radiation element is used, it may be centered in a ½ wavelength diameter circular or in a ½ wavelength by ½ wavelength square shaped ground plane. In one embodiment, it may be preferred to center the circuit board on a 10-inch by 20-inch rectangular ground plane. Circuit board 100 is preferably disposed on the ground plane 12 in an orthogonal relationship. Top printed circuit board planar surface 102 is shown in the foreground, while the surface of backside 120 is hidden from this view.

The term "balanced signal" is used throughout this discussion to mean any pair of parallel conductors carrying signals which are equal in amplitude and opposite in phase, such as is found in a 300-ohm parallel conductor, twin lead, antenna wire. An unbalanced signal is used herein to describe any such signal where there is one signal conductor and a reference ground. An example of an unbalanced signal would be a common 75-ohm co-axial television antenna cable.

Figure 2:
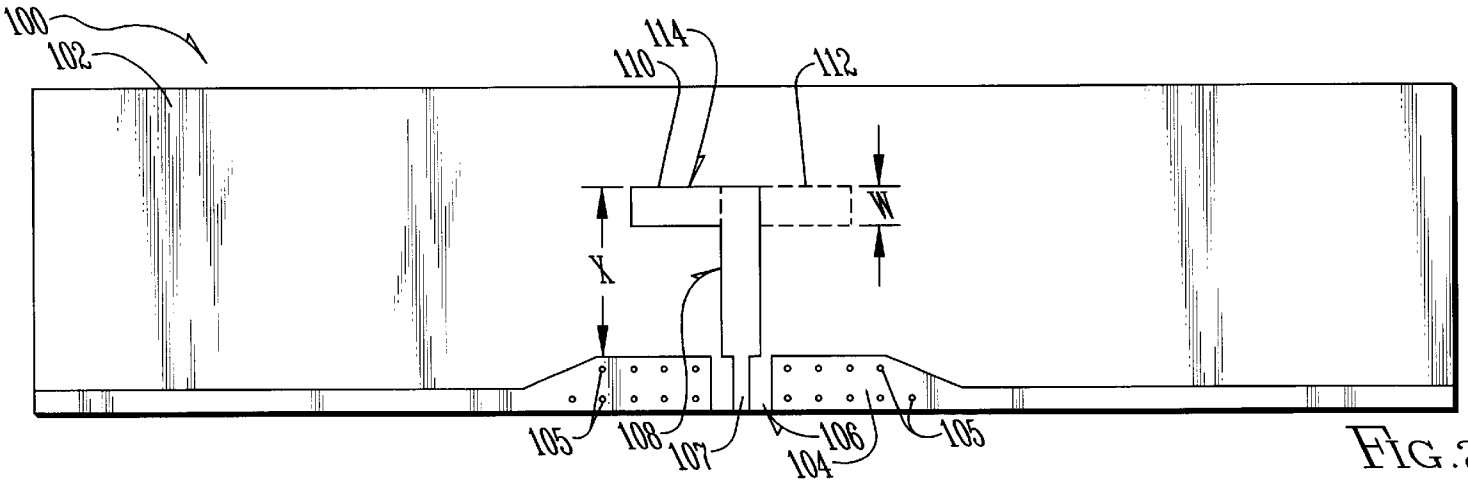
FIG. 2 is a plan view of the circuit board of FIG. 1 containing a balun of the present invention, coupled to a dipole antenna, where the dotted lines refer to a trace on the opposing side of the circuit board.
Figure 3:
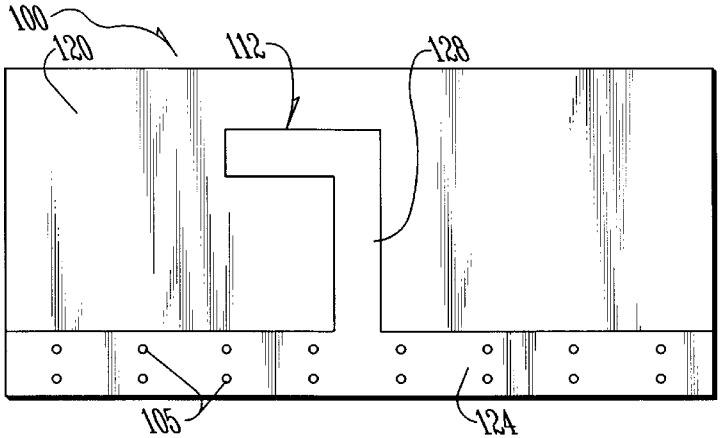
FIG. 3 is a plan view of the opposite side of the circuit board of FIG. 2.

Now referring to FIG. 2 and FIG. 3, there is shown a circuit card 100 of FIG. 1, including in FIG. 2, a top printed circuit board planar surface 102, upon which printed circuit elements can be formed and in FIG. 3 backside 120. One element formed on top printed circuit board planar surface 102 is ground plane 104. In a preferred embodiment, backside ground plane 124 is also disposed nearly identically and in vertical alignment on backside 120. Both ground plane 104 and backside ground plane 124 are coupled to ground plane 12. Ground plane 104 preferably has a plurality of vias or plated through holes 105 to thoroughly electrically couple it to backside ground plane 124. Ground plane 104 has an unplated void 106 therein, through which a signal is fed. Extending through unplated void 106 is microstrip feed line 107. On the backside 120 of the circuit board, there is no such unplated void and no such microstrip feed line therein. Instead, the backside ground plane 124 is preferably uninterrupted, except for the numerous vias or plated through holes 105 coupling the two ground plane sections. However, as distinguished from the ground plane 104 and backside ground plane 124, there are not any plated through holes or any structure connecting microstrip feed line 107 with the backside 120 of the circuit board; i.e., the backside ground plane 124. Coupled to microstrip feed line 107 is balun trace 108. Balun trace 108 is shown to be stepped up in width. This discontinuity in trace width between microstrip feed line 107 and balun trace 108 is included to maintain necessary impedance levels. In a preferred embodiment, microstrip feed line 107 is a 50-ohm microstrip line.

The microstrip feed line 107 is disposed over the relatively wide backside ground plane 124, and parasitic coupling through the air and then through the circuit board to backside ground plane 124 is possible. Balun trace 108 is not disposed over backside ground plane 124, and merely over backside balun trace 128 and, therefore, to maintain the same characteristic impedance, the balun trace 108 and backside balun trace 128 are required to be wider. Balun trace 108 is shown extending a distance "d" from the microstrip feed line 107. This physical distance d will vary, depending upon various design choices made in the design and construction of the system, but preferably it will have an electrical length of ¼ wavelength. The term "effective length" is described in the following equation:

$$PhysicalLength = \frac{Freespacelenth}{\sqrt{Er}}$$

Where $E_r'$ is the effective combined dielectric constant of the circuit board, □□, and that of air.

Other equations could be used to express this notion. The present invention is intended to include alternate relationships, which provide for or describe a structure and dimensions having similar performance, phase shifting, and resonance characteristics, etc.

For a ¼ wavelength balun, this distance will be approximately 0.65 inches. This dimension is appropriate for a feed signal of 2.5 GHz, fed through a 50-ohm microstrip feed line 107 (which is 0.104 inches in width and 0.038 inches in length) printed on a well-known and commercially available 0.060 BT epoxy circuit board. The circuit board preferably would have a dielectric thickness of 0.057 inches and a dielectric constant of 4.5. The balun trace 108 would preferably have a width of 0.144 inches. Balun trace 108 would be in vertical alignment with backside balun trace 128 on the backside 120 of the circuit board 100. Again, as with the microstrip feed line 107, no plated through holes would connect the opposing balun traces.

The balun of the present invention could be used for many purposes, and a feed for a dipole antenna may be a representative use. In other words, many things other than a dipole antenna could be coupled to and receive a balanced signal from the balun of the present invention. FIGS. 1–2 also show a top element 110 coupled to one side of the balun trace 108. Also shown, in dashed lines', in FIG. 2 is a backside bottom element 112, disposed on the backside 120 of the circuit board 100. Top element 110 and backside bottom element 112 will form a dipole antenna 114, with an overall length of preferably 1.7 inches. Top element 110 and backside bottom element 112 are in this described embodiment preferably 0.06 inches in width.

As with dimension d, the other dimensions of the present invention are variable, depending upon the design choices made, the frequency used, and the environment. It is assumed that the invention is not operated in a vacuum so the dielectric constant of air must be considered when designing the precise dimensions, especially the width of balun trace 108. More precisely, the effective dielectric constant is affected both by "air" and the PBC dielectric constant, similar to $E_r$ in the equation shown above. In a preferred embodiment, the space adjacent to the balun trace 108, the bottom side balun trace 128, the top element 110, and the bottom side bottom element 112 will be free of any conductive material for a distance of at least ¼ wavelength.

Figure 4:
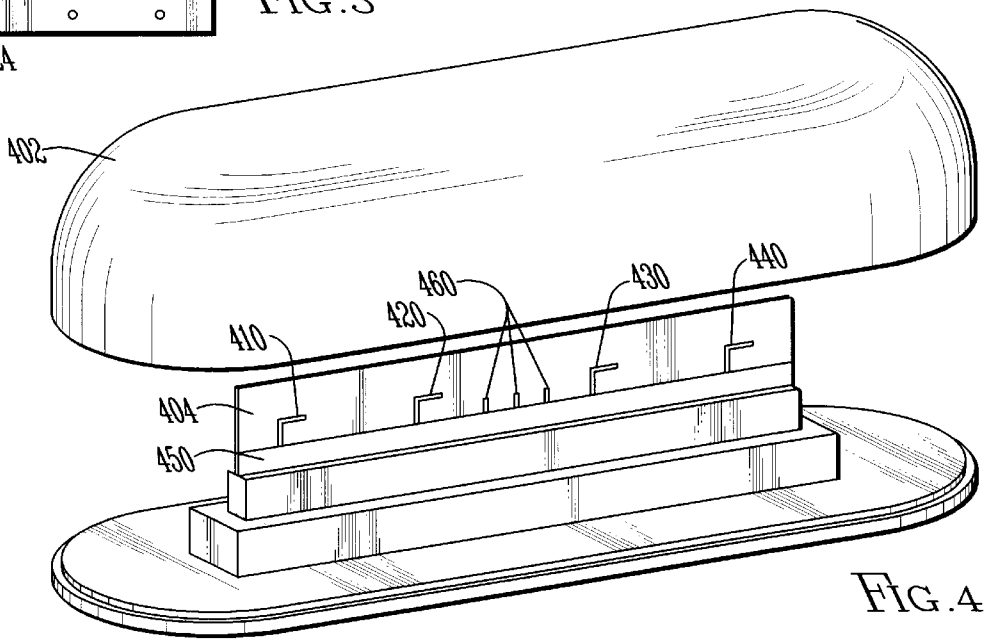
FIG. 4 is a view of an antenna array of the present invention including a plurality of baluns and dipole antennae.

Now referring to FIG. 4, there is shown an antenna array of the present invention including a radome cover 402 and an antenna array 404, including a first dipole antenna 410, second dipole antenna 420, third dipole antenna 430, and fourth dipole antenna 440 all disposed on a ground plane 450. Network impedance matching elements 460 are also shown.

Throughout this description, reference is made to near ¼ wavelength baluns and antennae, because it is believed that the beneficial aspects of the present invention would be most readily apparent when used in connection with such apparatus; however, it should be understood that the present invention is not intended to be so limited and should be hereby construed to include other lengths of baluns and antennae as well.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

What is claimed is:

1. An apparatus comprising:

a printed planar circuit board, having a predetermined thickness and a predetermined insulating material therein with a predetermined dielectric constant;

said printed planar circuit board having a top circuit board side and a bottom circuit board side;

a top side ground plane disposed on said top circuit board side;

a bottom side ground plane disposed on said bottom circuit board side;

said top side ground plane having a top side unplated void therein;

a top side microstrip feed line extending through said top side unplated void;

a top side balun trace is coupled to said top side microstrip feed line and extends beyond the top side void;

a bottom side balun trace is coupled to said bottom side ground plane; and, said top side balun trace and said bottom side balun trace having a predetermined length characteristic, which is configured to provide a predetermined phase shift in a feed signal applied thereto.

2. An apparatus of claim 1 wherein said bottom side ground plane does not have an unplated void therein disposed in vertical alignment with said top side unplated void.

3. An apparatus of claim 2 further comprising:

a plurality of plated through holes electrically connecting said top side ground plane and said bottom side ground plane.

4. An apparatus of claim 3 wherein said predetermined length characteristic is based upon a ¼ wavelength characteristic for a feed signal applied to said top side balun trace.

5. An apparatus of claim 4 wherein said top side balun trace has a width dimension which is greater than a width dimension of said top side microstrip feed line.

6. An apparatus of claim 5 wherein said top side balun trace has right and left side zones which are free of all conductive material disposed on the top circuit board side of said printed planar circuit board, for an orthogonal distance substantially the same as ¼ wavelength of a feed signal applied to said top side microstrip feed line.

7. An apparatus of claim 6 further including a base ground plane upon which said printed planar circuit board is orthogonally mounted, where said top side ground plane and said bottom side ground plane are electrically coupled with said base ground plane.

8. An apparatus of claim 7 further comprising:

a dipole antenna coupled to and receiving balanced signals from said top side balun trace.

9. An apparatus of claim 8 wherein said dipole antenna has a top element coupled to said top side balun trace and a bottom side bottom element which is coupled to said bottom side balun trace, wherein said top element and said bottom element have effective lengths of ¼ wavelength each for a feed signal applied to said top side balun trace.

10. An apparatus of claim 9 wherein:

said top side balun trace is substantially 0.65 inches in length and 0.144 inches in width;

said top side microstrip feed line is substantially a 50-ohm line; and said top side balun trace is fed with a signal of substantially 2.5 GHz.

11. An apparatus of claim 10 wherein said printed planar circuit board is an epoxy board having a dielectric thickness of substantially 0.057 inches and a dielectric constant of 4.5.

12. An apparatus of claim 11 wherein an orthogonal separation from said top side microstrip feed line to an adjacent side of said top side unplated void has a length dimension which is substantially twice as thick as a circuit board dielectric thickness of said printed planar circuit board.

13. An apparatus of claim 1 wherein an orthogonal separation from said top side microstrip feed line to an adjacent side of said top side unplated void has a length dimension which is substantially twice as thick as a circuit board dielectric thickness of said printed planar circuit board.

14. An apparatus of claim 13 wherein said top side balun trace has right and left side zones which are free of all conductive material disposed on the top circuit board side of said printed planar circuit board, for an orthogonal distance substantially the same as a ¼ wavelength of a feed signal applied to said top side microstrip feed line.

15. An apparatus of claim 14 wherein said top side balun trace has a width dimension which is greater than a width dimension of said top side microstrip feed line.

16. An apparatus comprising:

a printed circuit board with a first balun trace, which is isolated from a ground plane, and a second balun trace coupled to said ground plane, where the first and the second balun traces are printed In vertical alignment with each other, on opposing first and second sides of said printed circuit boards; and where the first and said second balun traces are sized and configured to convert an unbalanced signal applied at an Input end to a balanced signal at an output end;

said printed circuit board further comprising a microstrip feed line extending through a void in a ground plane on the first side of said printed circuit board wherein said microstrip feed line is directly coupled to said first balun trace and said second balun trace is directly coupled to a ground plane on the second side of said printed circuit board; and, a dipole antenna coupled to said output end of said first balun trace and said output end of said second balun trace for radiating said balanced signal.

17. An apparatus of claim 16 wherein said first balun trace has a width dimension that is greater than a width dimension of said microstrip feed line.

18. An apparatus of claim 16 further comprising a base ground plane upon which said printed circuit board is orthogonally mounted, where said ground plane on the first and second sides are electrically coupled with said base ground plane.

* * * * *